US008545166B2

(12) United States Patent
Maruthamuthu et al.

(10) Patent No.: US 8,545,166 B2
(45) Date of Patent: Oct. 1, 2013

(54) SYSTEM AND METHOD FOR CONTROLLING LEAK STEAM TO STEAM SEAL HEADER FOR IMPROVING STEAM TURBINE PERFORMANCE

(75) Inventors: Jegadeesan Maruthamuthu, Tamil Nadu (IN); Sudhahar Rajan, Tamil Nadu (IN); Kasiraman Sundar, Tamil Nadu (IN)

(73) Assignee: General Electric Company, Schenectady, NY (US)

( * ) Notice: Subject to any disclaimer, the term of this patent is extended or adjusted under 35 U.S.C. 154(b) by 606 days.

(21) Appl. No.: 12/845,022

(22) Filed: Jul. 28, 2010

(65) Prior Publication Data

US 2012/0027565 A1 Feb. 2, 2012

(51) Int. Cl.
*F01D 11/06* (2006.01)

(52) U.S. Cl.
USPC ..... 415/1; 415/20; 415/168.2; 415/175

(58) Field of Classification Search
USPC ..... 60/657; 415/1, 13, 20, 110, 168.1, 415/168.2, 175
See application file for complete search history.

(56) References Cited

U.S. PATENT DOCUMENTS

| | | | | |
|---|---|---|---|---|
| 3,604,206 | A * | 9/1971 | Baily | 60/644.1 |
| 4,149,386 | A * | 4/1979 | Luongo et al. | 60/663 |
| 5,388,411 | A | 2/1995 | McKeever et al. | |
| 5,749,227 | A * | 5/1998 | Smith et al. | 60/657 |
| 7,040,861 | B2 * | 5/2006 | Clifford et al. | 415/174.2 |
| 2006/0233634 | A1 * | 10/2006 | Tisenchek | 415/1 |
| 2011/0110760 | A1 * | 5/2011 | Sanchez | 415/1 |
| 2011/0214426 | A1 * | 9/2011 | Mehra et al. | 60/645 |

FOREIGN PATENT DOCUMENTS

| | | | |
|---|---|---|---|
| JP | 54-113708 | * | 9/1979 |
| JP | 2001-227303 | * | 8/2001 |

OTHER PUBLICATIONS

Nakadai, Steam Sealing Device, Sep. 5, 1979, Abstract of JP54-113708.*
Sato, Shaft Sealing Device of Steam Turbine, Aug. 24, 2001, Abstract of JP2001-227303.*
Machine translation of JP2001-227303.*

* cited by examiner

*Primary Examiner* — Edward Look
*Assistant Examiner* — Liam McDowell
(74) *Attorney, Agent, or Firm* — Ernest G. Cusick; Frank A. Landgraff

(57) ABSTRACT

A turbine system is provided wherein during self-sealing operating conditions, excess leakoff steam is restricted from being dumped to a steam seal header and is diverted into the working steam flow path, hence increasing net output and efficiency for the turbine system. A related method is also provided.

16 Claims, 3 Drawing Sheets

SYSTEM AND METHOD FOR CONTROLLING LEAK STEAM TO STEAM SEAL HEADER FOR IMPROVING STEAM TURBINE PERFORMANCE

BACKGROUND OF THE INVENTION

The disclosure relates generally to steam turbine technology and, more particularly, to channeling leak off steam for improving steam turbine performance A related method is also provided.

A steam seal system prevents the escape of steam from and/or the entry of air into the steam turbine through the clearance between turbine shaft and casing. The steam turbine casings are equipped with packing to control the flow of leakage along the shaft. The packing is usually of a labyrinth type including of series of teeth, which are arranged to fit close to the rotating shaft with minimal clearance. The small clearance and the teeth configuration provide resistance to flow that minimizes the leakage flow along the shaft.

There are two types of packing, pressure type and vacuum type. Pressure packing seals against a positive internal steam pressure at full load and prevents the escape of steam. At part load, when a vacuum exists throughout the turbine, the packing seals against air entry into the turbine. Pressure packing arrangements have a leak-off to a steam seal header (SSH), whose pressure may be regulated by steam seal regulating valves. Pressure packing may also have one or more higher-pressure leak-offs that discharge to steam insertion points on the turbine. At full turbine load, leakage steam flows from the pressure packing into the steam seal header. At startup and part load, steam flows from the steam seal header into the packing to seal them against outside air entry into the turbines.

Vacuum packing always seal against a vacuum, regardless of turbine load. Steam must be supplied to the vacuum packing from the steam seal header. On both pressure and vacuum packing, the outermost portion of the packing is maintained at a vacuum of by a gland exhaust system (GES). A mixture of steam, from the steam seal header, and air, drawn through the outermost packing rings, is drawn to a gland condenser for heat removal and disposal to a main condenser. The gland condenser may include a shell and tube heat exchanger to condense the steam and a motor driven blower to remove the air and hold the vacuum in the system.

A steam seal feed valve (SSFV) and a steam seal dump valve (SSDV) serve to control the pressure in the steam seal header during all modes of turbine operation, from turning gear to full load. A turbine control system may monitor the pressure in the SSH and position the valves to maintain a header pressure in the desired pressure range. At startup, the entire steam turbine is at vacuum. All the turbine packings require steam to be fed into them from the steam seal header. Steam from an external source (usually an auxiliary boiler) is fed to the SSH, under the control of the SSFV. The SSDV is closed during this operation.

The flow to the pressure packing normally decreases proportional to turbine load, until eventually the flow direction reverses and it starts feeding steam into the SSH. The flow to the vacuum packings is approximately constant irrespective of load. The load point, at which the flow from the pressure packings equals the flow into the vacuum packings, is called the "self-sealing" point. As load increases above the self-sealing point, the SSDV sets itself open to control the SSH pressure by dumping the excess steam to the main condenser with the SSFV now closed. The external steam source is isolated in this condition by closing the SSFV.

A further leak off path may be provided on the high pressure side of the shaft packing for the High Pressure (HP) turbine inlet side, the HP turbine outlet side and the Intermediate Pressure (IP) turbine inlet side. The associated leak off lines may be operatively connected for delivery of the leak off steam to various locations in the steam turbine system for use in power production. This leak off steam may be provided to such locations as a vertical joint between the IP/LP turbines, LP turbine steam admission pipe and shell stages of one of the HP turbine, IP turbine and the LP turbine.

Current steam seal systems are of a single set point sub-optimized design. For example, these designs for the turbine arrangement described above may provide a self-sealing load point ("SSLP") of about (30-45%). When a steam turbine "self seals", the terms generally refer to the condition where pressure packing seal steam flow is sufficient to pressurize and seal the vacuum packings. In higher load conditions however, the pressure packing steam flow going to the steam seal header increases but the vacuum packing requirement may be approximately constant. The additional steam coming from the pressure packings into the steam seal system thus may be dumped to the condenser using a SSDV without extracting any work.

Steam turbines are a relatively mature technology where efficiency improvements have great importance in a competitive market. Performance improvements with minimum additional cost are desirable from a competitive standpoint.

BRIEF DESCRIPTION OF THE INVENTION

A system and method are provided for improving output and efficiency of a steam turbine (ST) cycle by reducing the leakage steam to a steam seal header (SSH) that heretofore was dumped into the condenser as excess steam during operation above self-sealing condition. A line from high-grade steam leakage from pressure packing of the HP and IP turbines to the SSH may be blocked by adding restrictions in the line and controlling seal steam flow. The leak-off flow is directed to provide increased power output in the downstream stages of the steam expansion line, hence providing benefits in efficiency and output.

A first aspect of the present invention provides a steam turbine system a high pressure (HP) turbine operatively coupled to an intermediate pressure (IP) turbine and a low pressure (LP) turbine. Working steam flows through at least one of the HP turbine, the IP turbine and the LP turbine. A leak off path is provided from a pressure packing in proximity to at one or both of the HP turbine and the IP turbine. The leakoff steam flowing through the leakoff path is in fluid communication with the working steam flow within the steam turbine system. Steam seal lines from pressure packing on the one or both of the HP turbine and the IP turbine are fluidly connected to a seal steam header (SSH). The SSH is fluidly connected to a vacuum packing on the LP turbine and is adapted to maintaining a constant self-sustaining sealing pressure on a vacuum packing of the LP turbine. Means for restricting steam seal flow are provided and operatively connected to one or more steam seal lines between pressure packing for HP turbine and the IP turbine and the SSH.

A second aspect of the present invention provides a steam turbine system including at least a first steam turbine operatively coupled to a low pressure (LP) turbine, wherein the steam turbine system becomes self-sealing at a system load level. A working steam flowpath exists within the first steam turbine and the LP turbine. A leak off path, from a pressure packing in proximity to the first steam turbine, communicates with the working steam flow within the steam turbine system.

One or more steam seal lines from a pressure packing on the first steam turbine fluidly connects to a steam seal header (SSH). The SSH fluidly connects to a vacuum packing on the LP turbine and is adapted to maintaining a constant self-sustaining sealing pressure on a seal packing of the LP turbine. Means for providing a sealing steam flow restriction is operatively connected to at least one of the steam seal lines between the first steam turbine and the SSH. A controller is provided responsive to sealing steam flow conditions of the steam turbine system. The controller initiates the means for the sealing steam flow restriction so as to beneficially provide leakage flow to the working steam flow.

A further aspect of the present invention provides a method of operating a steam turbine system for improving power output. The method includes providing a high pressure (HP) turbine operatively coupled to an intermediate pressure (IP) turbine and a low pressure (LP) turbine. A leak off steam line couples one or more pressure packings of the HP turbine and the IP turbine to a working steam flow within the turbine system, thereby providing for greater power output. The method includes maintaining a constant self-sustaining sealing pressure to the HP turbine, IP turbine and LP turbine through fluid connections to a steam seal header (SSH), where the steam seal header includes a steam seal feed valve from an auxiliary steam supply and a steam seal dump valve to a steam sink. The method also includes restricting the sealing steam flow from at least one of the HP turbine and the IP turbine to the SSH under self-sealing conditions for the steam turbine system. The method further includes beneficially directing excess seal steam restricted from the HP turbine and the IP turbine to the SSH under self-sealing conditions of the steam turbine system to a working steam flow of the steam turbine system.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

The present invention has many advantages including providing a turbine system wherein during layout or maximum load conditions, excess leakoff steam is blocked from being dumped by a steam seal header and diverted into the working steam flow path, hence increasing net output and efficiency for the turbine system. Limiting leak off steam being dumped by the steam seal header to the condenser further allows decreased condenser duty.

Figure 1:
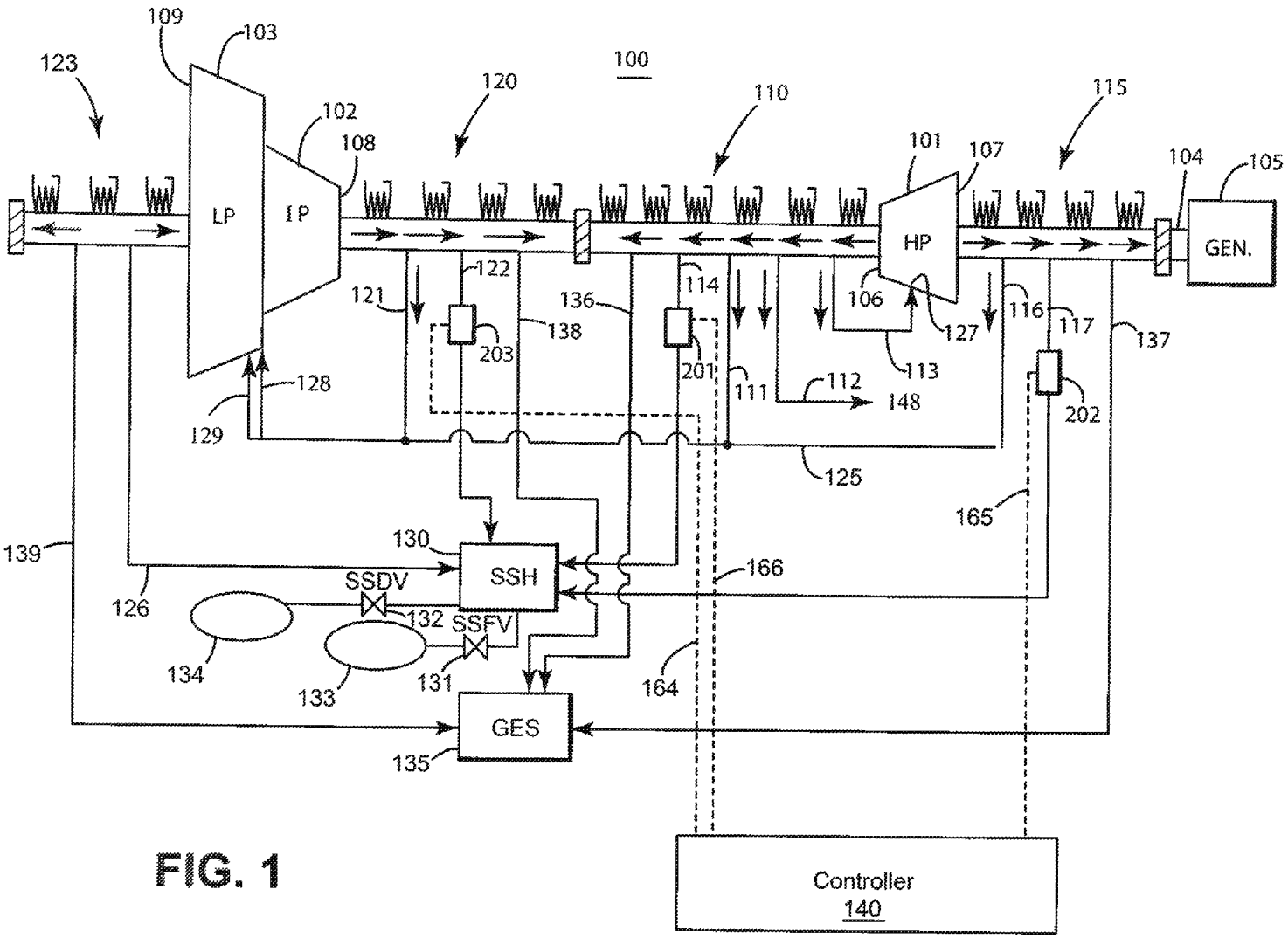
FIG. 1 shows a schematic diagram of a steam turbine system according to embodiments of the invention.

Referring to FIG. 1, a schematic diagram of embodiments of a steam turbine system 100 according to the invention and under self-sealing conditions is illustrated. Steam turbine system 100 includes an HP turbine 101, an IP turbine 102 and an LP turbine 103 that may be operatively coupled on a common shaft 104 to drive electrical generator 105. However, the present invention is not restricted to the above-mentioned turbine configuration, common shaft or to an electrical generator as the load on the shaft.

Multiple packing segments 110 extend along the common shaft 104 on steam inlet side 106 of the HP turbine 101. Multiple packing segments 115 extend along the common shaft 104 on steam outlet side 107 of HP turbine 101. Multiple packing segments 120 extend on the steam inlet side 108 of IP turbine 102. Multiple packing segments 123 extend along the common shaft on the downstream side 109 of LP turbine 103.

One or more leakoff lines may be fluidly connected between packing segments in closest proximity to the shaft outlet from each of the turbines to supply leakage steam for useful work in the turbine system. From the steam inlet side 106 of the HP turbine 101, leakoff line 111 may supply leakoff steam to vertical joint header 125, leakoff line 112 may supply leakoff steam to HP exhaust steam line 148, and leakoff line 113 may supply HP turbine shell stage 127. From the steam outlet side 107 of HP turbine 101, leakoff line 116 may supply steam to vertical joint header 125. From the steam inlet side 108 of IP turbine 102, leakoff line 121 may supply steam to the vertical joint header 125. Vertical joint header 125 may supply steam to the vertical joint between the IP and LP turbines and to the LP turbine steam admission pipe 128, 129 for useful work. Here the leakoff header, under self-sealing conditions, may beneficially supply high-grade steam from packing leakoff to locations in the turbine system where system power output may be enhanced.

A steam seal header (SSH) 130 may be fluidly connected by seal steam header lines to locations in the packing segments physically outboard from the associated locations on the HP turbine and IP turbine for the connections for the first leakoff header. Steam seal header line 114 may be fluidly connected to steam inlet side 106 of HP turbine 101. Steam seal header line 117 may be fluidly connected to steam outlet side 107 of HP turbine 101. Steam seal header line 122 may be fluidly connected to steam inlet side 108 of IP turbine 102. The SSH may also be fluidly connected with steam seal header line 126 to the LP turbine 103.

Steam seal header lines may be regulated to a constant pressure by steam seal header (SSH) 130 that delivers steam flow to seal packings of any of the steam system turbines when the system is below required sealing conditions. In one embodiment, SSH 130 maintains a pressure of approximately 0.13 megaPascal (MPa) (approximately 18.7 psia). According to a turbine system controller (not shown), the SSH may be supplied with augmenting steam from a steam supply feed valve (SSFV) 131 from an auxiliary boiler 133 or other steam source to maintain the header pressure or may dump steam to steam supply dump valve 132 (SSDV) to a condenser 134 or other heat sink. However, different turbine configurations and seal packings may require different sealing pressures.

A gland exhaust header may be fluidly connected at the outermost packing segments to a gland exhaust system 135 (GES). A mixture of steam, from the steam seal header, and air, drawn through the outermost packing rings, is drawn to a gland condenser (not shown) for heat removal and disposal to a main condenser (not shown). Gland exhaust lines 136, 137, 138 139 may fluidly connect to the steam inlet side 106 of HP turbine 101, steam exhaust side 107 of HP turbine 101, steam inlet side 108 of IP turbine 102, and steam outlet side 109 of LP turbine 103, respectively.

To more effectively utilize the packing leak off that is available at higher turbine loads, excess leakoff steam that would otherwise be sent to the SSH 130 causing the SSDV 132 to dump the leakage to the condenser (not shown), means for restricting flow may be provided in one or more of the SSH lines 114, 117, and 122 to block excess steam flow to the SSH 130. Restricting flow in the SSH lines 114, 117 and 122, will raise pressure in the SSH header line packing segments, forcing an increased flow of seal leakage steam through the first leakoff line 111 second leakoff line 116 and third leakoff line 121 thereby increasing steam flow to loads downstream on the first leakage path such as the vertical joint of the IP/LP turbine and the LP turbine steam admission pipe. The leak off steam is thus utilized in the working steam flow path resulting in increased power output on the shaft. No change need be made to packing arrangements on existing turbine systems to implement the present invention.

Figure 2:
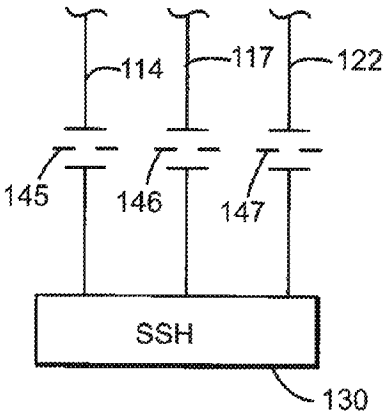
FIG. 2 illustrates orifices as a means for directing excess seal steam flow into a working steam flow path.
Figure 4:
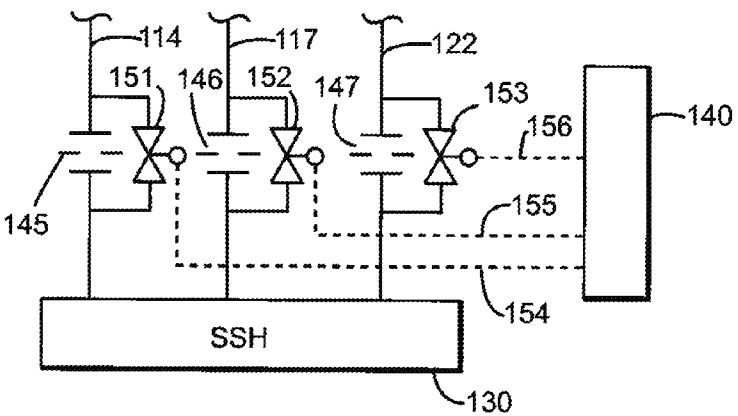
FIG. 4 illustrates isolation valves controlled by a seal steam controller in combination with orifices as a means for directing excess seal steam flow into a working steam flow path.
Figure 3:
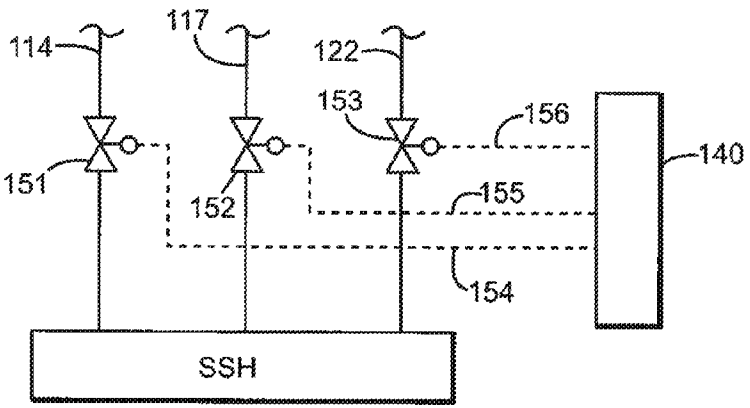
FIG. 3 illustrates isolation valves controlled by a seal steam controller as a means for directing excess seal steam flow into a working steam flow path.
Figure 5:
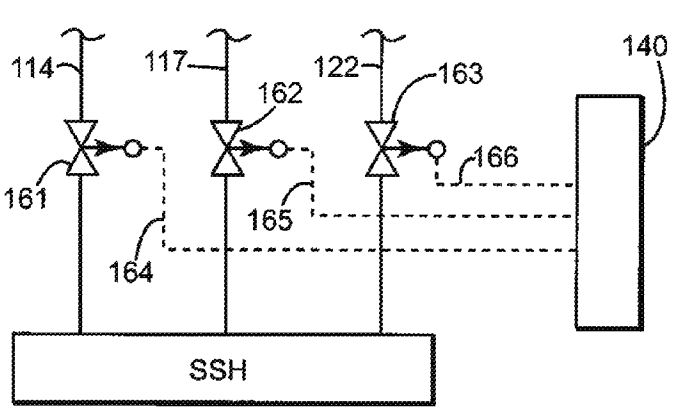
FIG. 5 illustrates throttling valves controlled by a seal steam controller as a means for directing excess seal steam flow into a working steam flow path.

Several embodiments may be provided for implementing means for restricting sealing leak off flow 201, 202, 203 as shown in FIG. 1. FIG. 2 illustrates orifices 145, 146, 147 that may be placed in one or more of the steam seal lines 114, 117, 122 to limit flow to the SSH 130 thereby increasing leak off flow to the working steam path (FIG. 1). FIG. 3 illustrates isolation valves 151, 152, 153 may be provided in one or more of the lines 114, 117, 122 to limit flow to the SSH 130 with control of the valves being provided by signals 154, 155, 156 from controller 140. FIG. 4 illustrates isolation valves 151, 152, 153 may be provided in parallel with one or more of the orifices 145, 146, 147 in one or more of the steam seal lines 114, 117, 122, where the controller 140 may signal 154, 155, 156 operation of the isolation valves 151, 152, 153 to direct excess steam to the working steam path. In another variation of the means for restricting flow, throttling valves 161, 162, 163 may be placed in one or more of the seal steam header lines 114, 117, 122, where the throttle valves operate under the control of the controller 140 in response to control signals 164, 165, 166.

Controller 140 may include any now known or later developed industrial control mechanism, and may be included as a separate unit or part of a larger control system, such as a turbine controller. Controller 140 may be coupled to any required sensors, e.g., pressure transmitter at seal packing or pressure transmitter at steam seal header, to attain appropriate load conditions, and may include any required control logic necessary to control the isolation or throttling valves. An existing pressure sensor (not shown) for control of SSFV 131 and SSDV 132 in the SSH 130 may be employed.

While the turbine configuration is illustrated with an HP turbine, IP turbine and LP turbine, it should be understood that the present invention may be employed effectively with any number and configuration of steam turbines in a steam turbine system that become self-sealing at higher loads and would otherwise need to dump seal steam and for which the seal steam may be beneficially employed were it not dumped.

Figure 6:
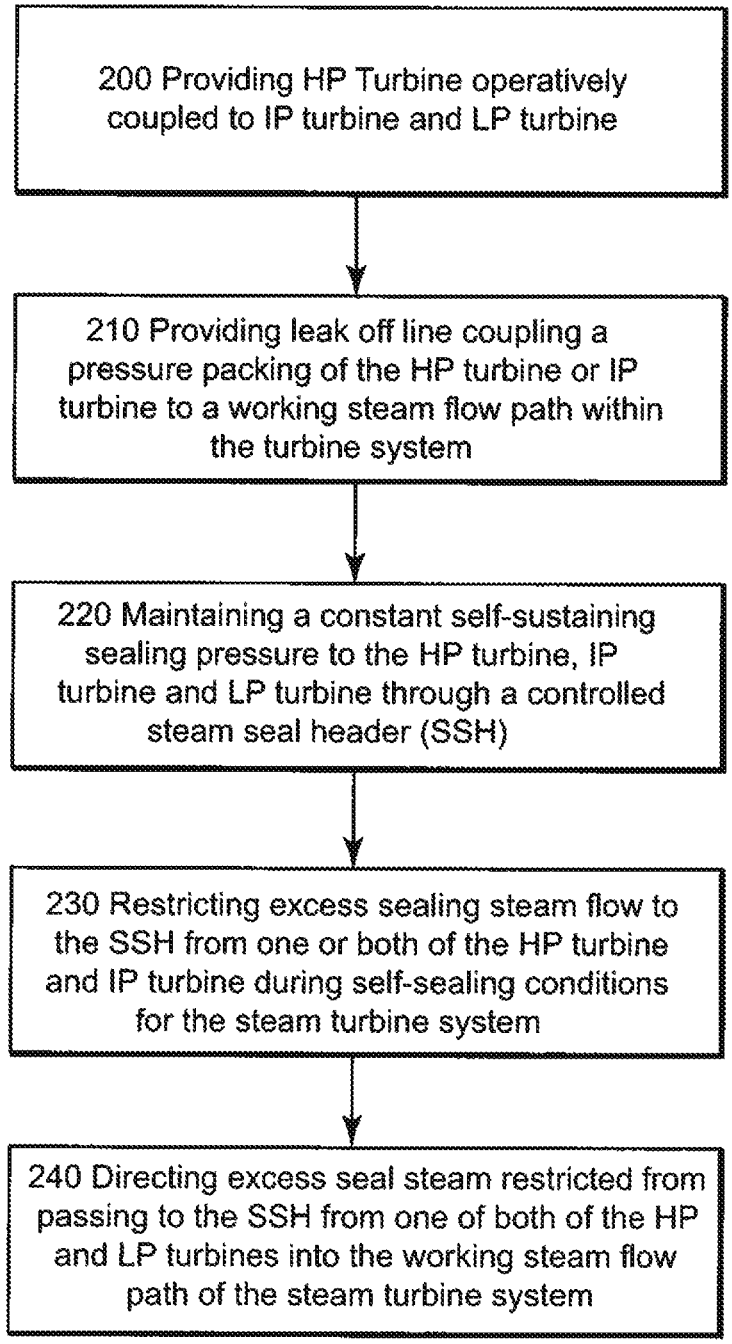
FIG. 6 illustrates a flowchart for a method for beneficially directing excess seal steam flow into a working steam flow path.

FIG. 6 illustrates a flow chart for a method of operating a steam turbine system for enhancing sealing steam delivery to the working steam flow. The method step 200 includes providing a high pressure (HP) turbine operatively coupled to an intermediate pressure (IP) turbine and a low pressure (LP) turbine. Step 210 includes providing leak off line coupling a pressure packing of at least the HP turbine or a pressure packing of the IP turbine to a working steam flow within the turbine system. Step 220 maintains maintaining a constant self-sustaining sealing pressure to the HP turbine, IP turbine and LP turbine through fluid connections to a controlled steam seal header (SSH). The SSH may include a steam seal feed valve from an auxiliary steam supply and a steam seal dump valve to a steam sink. Step 230 includes restricting sealing steam flow from one or both of the HP turbine and the IP turbine to the SSH under self-sealing conditions for the steam turbine system. Step 240 beneficially directs excess seal steam restricted from one or both of the HP turbine and the IP turbine to the SSH under self-sealing conditions of the steam turbine system to a working steam flow of the steam turbine system.

Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A steam turbine system comprising:

a high pressure (HP) turbine operatively coupled to an intermediate pressure (IP) turbine and a low pressure (LP) turbine;

a working steam flow within at least one of the HP turbine, the IP turbine and the LP turbine;

a leakoff path from a pressure packing in proximity to at least one of the HP turbine and the IP turbine, wherein leakoff steam flowing through the leakoff path is in fluid communication with the working steam flow within the steam turbine system;

a plurality of steam seal lines from at least one of a pressure packing on the HP turbine and the IP turbine being fluidly connected to a seal steam header (SSH), wherein the SSH is fluidly connected to a vacuum packing on the LP turbine and is adapted to maintain constant self-sustaining sealing pressure on a seal packing of the LP turbine;

means for restricting sealing steam flow operatively connected to at least one of the steam seal lines between HP turbine seal packing and the SSH and an IP turbine seal packing and the SSH; and a controller operatively connected to the means for restricting sealing steam flow and adapted to isolating excess sealing steam from the steam seal header, and wherein the means for restricting sealing steam flow are activated by the controller according to a pressure on the steam seal header according to a sequence of isolation sealing steam flow from of a HP inlet side, a HP outlet side, an IP inlet side, an IP outlet side, and a LP inlet side.

2. The steam turbine system according to claim 1, wherein the working steam flow comprises a steam flow to at least one of a HP exhaust steam line and a steam flow within a shell stage of the HP turbine.

3. The steam turbine system according to claim 1, wherein the working steam flow includes at least one of a steam flow at a vertical joint between the IP turbine and the LP turbine and a steam flow within a steam admission pipe for the LP turbine.

4. The steam turbine system of claim 1, wherein the leakoff path from a pressure packing in proximity to at least one of the HP turbine and the IP turbine comprises:

a pressure packing on the HP turbine inlet steam side, a pressure packing on the HP turbine outlet steam side and a pressure packing on the IP turbine inlet steam side being fluidly connected to the seal steam header.

5. The steam turbine system of claim 1, wherein the means for restricting sealing steam flow comprises: a stop valve in parallel with an orifice.

6. The steam turbine system of claim 1, wherein the sealing steam flow restriction means comprises a throttle valve.

7. The steam turbine system of claim 1 further comprising:

a turbine control system including a turbine load signal, wherein the means for restricting sealing steam flow are activated by the controller according to a turbine load signal from the turbine controller.

8. A steam turbine system comprising:

at least a first steam turbine operatively coupled to a low pressure (LP) turbine, wherein the steam turbine system becomes self-sealing at a system load level and further comprises a high pressure (HP) turbine operatively coupled to an intermediate pressure (IP) turbine and the low pressure (LP) turbine;

a working steam flow within the at least one first steam turbine and the LP turbine;

a leakoff path from a pressure packing in proximity to at least one steam turbine, wherein leakoff steam flowing through the leakoff path is in fluid communication to a working steam flow within the steam turbine system;

at least one steam seal line from a pressure packing on the at least one steam turbine being fluidly connected to a seal steam header (SSH), wherein the SSH is fluidly connected to a vacuum packing on the LP turbine and is adapted to maintaining a constant self-sustaining sealing pressure on a seal packing of the LP turbine;

at least one means for sealing steam flow restriction operatively connected to at least one of the steam seal line between the at least one steam turbine and the SSH; and a controller responsive to sealing steam flow conditions of the turbine system, wherein the controller initiates the at least one means for sealing steam flow restriction wherein the at least one means for sealing steam flow restriction is activated by the controller according to a pressure on the SSH according to a sequence of isolation sealing steam flow from of the HP inlet side, the HP outlet side, the IP inlet side, the IP outlet side, and the LP inlet side.

9. The steam turbine system of claim 8, wherein the means for sealing steam flow restriction comprises: at least one orifice.

10. The steam turbine system of claim 8, wherein the means for sealing steam flow restriction comprises: at least one isolation valve.

11. The steam turbine system of claim 8, wherein the means for sealing steam flow restriction comprises: at least one throttle valve.

12. The steam turbine system of claim 8, wherein the controller activates the means for sealing steam flow restriction according to a pressure in the SSH.

13. A method of operating a steam turbine system, the method comprising:

providing a high pressure (HP) turbine operatively coupled to an intermediate pressure (IP) turbine and a low pressure (LP) turbine, and a leak off line coupling at least one of a pressure packing of the HP turbine and a pressure packing of the IP turbine to a working steam flow within the turbine system;

maintaining a constant self-sustaining sealing pressure to the HP turbine, IP turbine and LP turbine through fluid connections to a steam seal header (SSH) comprising a steam seal feed valve from an auxiliary steam supply and a steam seal dump valve to a steam sink;

restricting sealing steam flow from at least one of the HP turbine and the IP turbine to the SSH under self-sealing conditions for the steam turbine system; and beneficially directing excess seal steam restricted from at least one of the HP turbine and the IP turbine to the SSH under self-sealing conditions of the steam turbine system to a working steam flow of the steam turbine system by controlling a sequence of isolation sealing steam flow from of a HP inlet side, a HP outlet side, an IP inlet side, an IP outlet side, and a LP inlet side.

14. The method of claim 13, wherein the step of restricting sealing steam flow comprises:

at least one of blocking steam seal flow from the SSH by at least one of orifices, blocking valves and throttle valves.

15. The method of claim 14, wherein the step of blocking comprises:

controlling a position of at least one of the blocking valves and the throttle valves by signaling from a controller.

16. The method of claim 15, wherein the step of controlling comprises:

determining a self-sealing condition on the SSH; and signaling a position to at least one of the blocking valves and the throttle valves.

* * * * *